United States Patent [19]

Posner

[11] Patent Number: 4,735,023

[45] Date of Patent: Apr. 5, 1988

[54] GUARDRAIL WINDOW ASSEMBLY FOR BALCONY OR PATIO

[76] Inventor: Carole Posner, 10180 W. Bay Harbor Dr., Bay Harbor Island, Fla. 33154

[21] Appl. No.: 26,567

[22] Filed: Mar. 17, 1987

[51] Int. Cl.[4] ..... E04B 1/346

[52] U.S. Cl. ..... 52/66; 52/67; 52/474; 52/632; 49/125; 160/193

[58] Field of Search ..... 52/64, 66–71, 52/1, 72, 474, 632; 49/125; 160/193, 194

[56] References Cited

U.S. PATENT DOCUMENTS

| | | | |
|---|---|---|---|
| 982,580 | 1/1911 | Elmer, Jr. | 49/125 X |
| 1,279,819 | 9/1918 | Zingsheim et al. | 52/67 |
| 1,751,358 | 3/1930 | Rice et al. | 49/125 X |
| 3,589,084 | 6/1971 | Reed . | |
| 3,845,591 | 11/1974 | Stine | 52/67 |
| 3,977,123 | 8/1976 | Clay, Jr. et al. | 49/125 |
| 4,083,149 | 4/1978 | Hickman et al. . | |
| 4,175,361 | 11/1979 | Kumode | 52/67 X |
| 4,283,889 | 8/1981 | Dunn | 52/66 |
| 4,335,547 | 6/1982 | Maxwell . | |
| 4,414,784 | 11/1983 | Masters . | |
| 4,443,978 | 4/1984 | Butler . | |
| 4,616,451 | 10/1986 | Glick | 52/66 |

*Primary Examiner*—William F. Pate, III
*Assistant Examiner*—Richard E. Chilcot, Jr.
*Attorney, Agent, or Firm*—John Cyril Malloy

[57] ABSTRACT

In the illustrated embodiment, the guardrail window assembly includes three outer stationary rectangular superstructures. Each superstructure forms a wall section of the assembly and adjacent superstructures are connected together by vertical posts that rise from the patio or balcony area. Each superstructure longer than four (4) feet has a header, a footer and a pair of upright jambs. Window panes are retained by window frames. Each superstructure has at least one telescoping column uprightly attached to the footer. Each telescoping column includes, in this embodiment, three column segments. The lower column segment is fixed to the footer and the upper column segments telescope from the lower column segment. The window frames are attached on one side to one column segment and the opposing side of the window frame is either set within a groove in the jamb or is affixed to another column segment of an adjacent telescoping column. When the telescoping columns are fully extended to form a fully extended column, the windows are generally vertically aligned to form a windowed wall section. One window is fixed to the footer, to the jamb and to the lower column segment of the column. The other two vertically aligned windows of the window set are vertically movable with respect to the fixed lower window. The vertically movable windows are raised by action of the telescoping column and a cable and motor and/or manual device wherein the cable runs within the window groove in the jamb.

11 Claims, 3 Drawing Sheets

GUARDRAIL WINDOW ASSEMBLY FOR BALCONY OR PATIO

BACKGROUND OF THE INVENTION

The present invention relates to a guardrail window assembly for a balcony or patio.

Many dwellings include a balcony or patio area that is outside the dwelling but is accessible from the interior of the dwelling. For example, a single family residence may have a cement patio extending from a backdoor of the residence. More importantly, a multifamily dwelling such as a condominium or high-rise apartment may have balconies cantilevered from the outside walls of the building. The guardrail feature is important for these dwellings. People living in these dwellings may want to use their patios or balconies during inclement weather but are unable to do so because of the exposed nature of these patio or balcony areas. The present invention relates to a guardrail window assembly which raises a plurality of windows to substantially enclose a balcony or patio area.

One prior art system remotely related to such a window assembly is found in U.S. Pat. No. 4,083,149 to Hickman, et al. Hickman, et al., disclose a drop vent wall system wherein a well segment is movable up and down using a vertically positioned pair of poles attached to the outside of a structure. The poles extend from the eaves of the structure to a positioned proximate the footer of the structure. U.S. Pat. No. 4,443,978 to Butler discloses a movable, thermal barrier for a solar heated building. The barrier is vertically movable and is guided by a plurality of vertically disposed poles or rods. U.S. Pat. No. 3,589,084 to Reed discloses a translucent, wall panel enclosure. The wall panels move back and forth guided by tracks within the joists in a structure. U.S. Pat. No. 4,414,784 to Masters discloses a greenhouse structure. The greenhouse structure has a movable wall segment that is generally swingable about a pivot point at the upper most edge of the structure. U.S. Pat. No. 4,335,547 to Maxwell discloses a balcony greenhouse. The entire greenhouse is movable to a lateral position parallel to the building wall.

OBJECTS OF THE INVENTION

It is an object of the present invention to provide a guardrail window assembly for a balcony or patio that does not utilize permanent, vertical supports inboard of a superstructure that defines each wall section of the assembly.

It is another object of the present invention to provide a plurality of telescoping columns wherein each column holds a one side of a window frame.

It is an additional object of the present invention to provide a modular, window assembly.

It is a further object of the present invention to provide a window assembly that creates the appearance of a railed, balcony or patio area when the window assembly is lowered.

It is an additional object of the present invention to provide a window assembly wherein the degree of enclosure can be adjusted by varying the height of the plurality of windows in the assembly.

It is a further object of the present invention to provide a lifting mechanism both at the longitudinal ends of the window frames as well as within the telescoping columns disposed at the opposing end of the window frames.

It is another object to provide a guardrail for the balcony when the windows are lowered.

SUMMARY OF THE INVENTION

In the illustrated embodiment, the window assembly includes three outer stationary rectangular superstructures. Each superstructure forms a wall section of the assembly and adjacent superstructures are connected together by vertical posts that rise from the patio or balcony area. Each superstructure has a header, a footer and a pair of upright jambs. Window panes are retained by window frames. Each superstructure has at least one telescoping column uprightly attached to the footer. Each telescoping column includes, in this embodiment, three column segments. The lower column segment is fixed to the footer and the upper column segments telescope from the lower column segment. The window frames are attached on one side to one column segment and the opposing side of the window frame is either set within a groove in the jamb or is affixed to another column segment of an adjacent telescoping column. When the telescoping columns are fully extended to form a fully extended column, the windows are generally vertically aligned to form a windowed wall section. One window is fixed to the footer, to the jamb and to the lower column segment of the column. The other two vertically aligned windows of the window set are vertically movable with respect to the fixed lower window. The vertically movable windows are raised by action of the telescoping column and a cable and motor and/or manual device wherein the cable runs within the window groove in the jamb.

BRIEF DESCRIPTION OF THE DRAWINGS

Further objects and advantages of the present invention may best be found in the accompanying detailed description of the preferred embodiments when taken in conjunction with the accompanying drawings in which.

DETAILED DESCRIPTION OF THE PREFERRED EMBODIMENTS

The present invention relates to a window assembly for a patio or balcony area.

Figure 1:
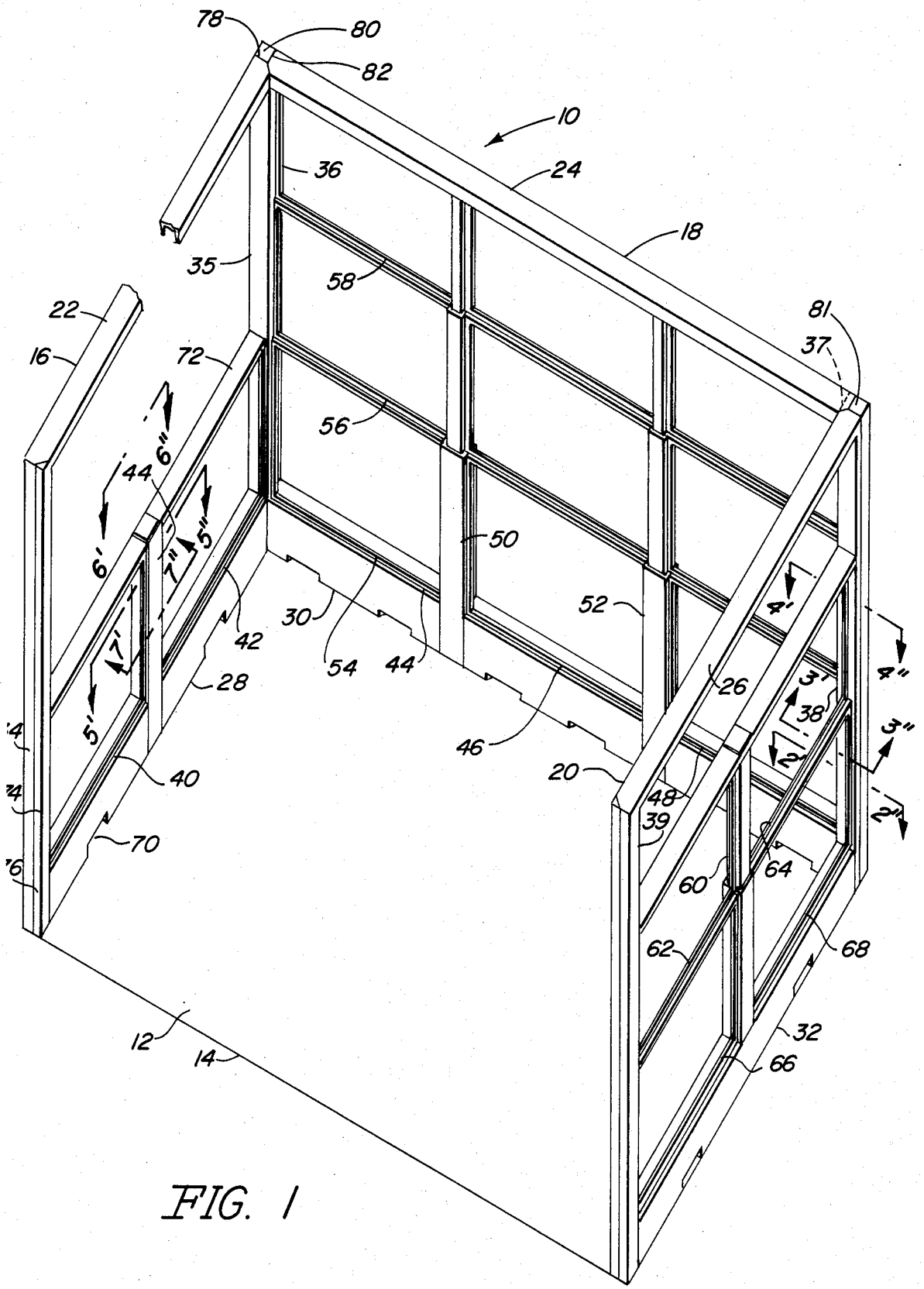
FIG. 1 illustrates a perspective, plan view of the window assembly in accordance with the principles of the present invention.

FIG. 1 illustrates a perspective view of guardrail window assembly 10 that is mounted on surface 12 of a balcony or patio 14. Assembly 10 includes left side superstructure 16, front superstructure 18 and right side superstructure 20.

Each superstructure is generally similar in that it includes headers 22, 24 and 26, footers 28, 30 and 32, and a pair of jambs 34, 35, for superstructure 16, jambs 36, 37 for superstructure 18, and jambs 38 and 39 for superstructure 20.

In this embodiment, superstructure 16 has two sets of windows 40 and 42 that are separated by a telescoping column 44. Column 44 is a fully collapsed or foreshortened column, therefore, the three windows which make up each window set 40 and 42 in this embodiment are not shown in great detail. With respect to superstructure 18, window sets 44, 46 and 48 are separated by telescoping columns 50 and 52. In superstructure 18, columns 50 and 52 are fully extended and each window of each window set is clearly shown. For example, in window set 44, a lower window 54 encloses a lower, left-hand section of the superstructure, window 56 encloses an intermediate, left-hand section of the superstructure, and upper-most window 58 covers the upper, left-hand section of superstructure 18.

As for superstructure 20, telescoping column 60 is partially extended and windows 62 and 64 of windows sets 66 and 68 cover approximately ⅔ of the area encompassed by that structure. The other two windows of window sets 66 and 68 are not well shown since telescoping column 60 is only partially extended.

Footers 28, 30 and 32 have a plurality of grooves, one of which is groove 70 along their bottom surface. Groove 70 provides a drain passage for water that accumulates on surface 12 such that the water drains from that surface out of the balcony or patio area.

Each superstructure has the generally the same jamb, footer and header design. For example, superstructure 16 has a header 22 with a downwardly open groove 70 that companionately mates with railing 72. As will be discussed later, railing 72 runs the longitudinal length of the upper edges of the window frames for window sets 40 and 42. This companionate seating when column 44 is fully extended provides stabilization of the wall of windows, i.e., window sets 40 and 42.

Jambs 34 and 35 are at each longitudinal ends of header 22 and footer 28. The superstructure is modular in nature, therefore, jamb 34 is similar to jamb 35. Jamb 34 has diagonal spacer 74 which provides a flat surface 76 that is adapted to be flush with the exterior surface of dwelling or structure. Header 22 is connected to jambs 34 and 35 by any convenient mechanism. Likewise, jambs 34 and 35 are connected to footer 28 by any well known device. Jamb 35 has an outboard surface 78 that is flush against vertical corner post 80. Likewise, jamb 36 has surface 82 that is flush against the other adjacent surface of corner post 80.

Corner post 80 ideally protrudes significant depth into patio or balcony area 14 to provide a solid upright for the superstructure. Similarly, footer 28 is very securely attached to patio or balcony area 14. Such attachment mechanisms are know in the art. Also, the footer section immediately below telescoping column 44 (as well as the other telescoping columns) may have additional moring or securing devices that enable the column to support the windows in a foreshortened column as shown with respect to superstructure 16, a fully extended column as shown with respect to superstructure 18, or a partially extended column as shown with respect to superstructure 20.

It should be noted that FIG. 1 does not show in great detail the columns, the window sets or the jamb structures. These items are shown in detail on FIGS. 2 through 7.

Figure 2:
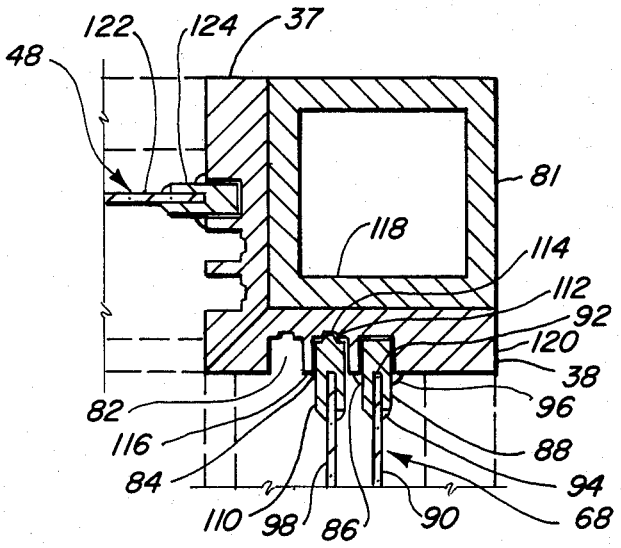
FIG. 2 illustrates a cross-sectional view of two adjacent jambs and the connecting vertical post as viewed from the perspective of section line 2'—2" in FIG. 1.

FIG. 2 illustrates a cross-sectional view of jambs 37 and 38 and a corner post 81 from the perspective of section lines 2'—2" in FIG. 1. Similar numerals designate similar items throughout all the Figures. In this embodiment, each jamb has three window frames channels, for example, jamb 38 has window frame channels 82, 84 and 86. These window frame channels are generally categorized as one of two types, those channels having movable window frames in them such as channels 82 and 84, and the channel having a fixed window frame such as channel 86. Window frame 88 retains a pane 90. In this embodiment, pane 90 is a glass or plastic, transparent window pane. However, it is possible to have opaque panes or other types of panes which form a wall when the telescoping columns are fully extended within a particular superstructure. Returning to the specific embodiment, window pane 90 is set within pane groove 92 along the inboard side of the window frame. Calking 94 provides a weather seal around the entire window pane. Further calking 96 seals window frame 88 to jamb 38. Window frame 88 is fixed within channel 86 by conventional techniques.

Window set 68 not only includes pane 90 and frame 88 but also includes pane 98 and frame 110 and another pane and frame not shown in FIG. 2. Frame 110 includes a tab or ridge 112 that companionately mates with central groove 114 on the inboard facing surface of channel 84. That surface is coplanar with inboard surface 116 of jamb 38. The terms "inboard" and "outboard" are used herein refer to the orientation of items with respect to a particular superstructure. Therefore, surface 118 of jamb 38 is the outboard surface of the jamb and surface 116 is the inboard surface. Surface 120 is the exterior surface of the jamb.

Window set 48 of superstructure 18 is fully extended to form a wall (see generally FIG. 1) and therefore FIG. 2 shows a lower or fixed window pane 122 set within window frame 124. Frame 124 is affixed to jamb 37.

Figure 3:
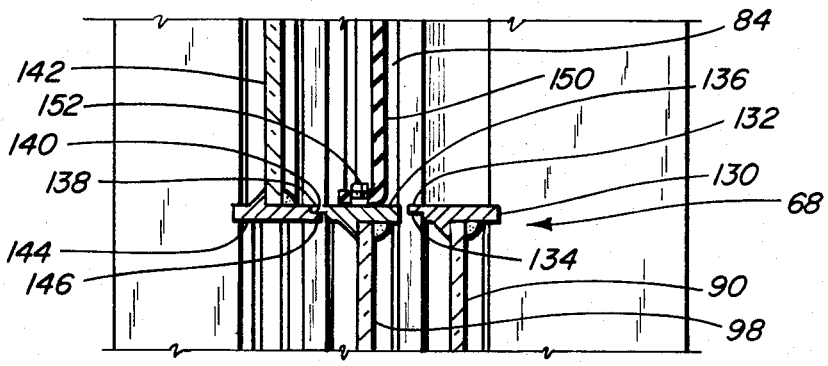
FIG. 3 illustrates a cross-sectional view from the perspective of section line 3'—3" in FIG. 1.

FIG. 3 illustrates a cross-sectional, side view of window set 68 as viewed from the perspective of section lines 3'—3" in FIG. 1. Frame 88 for window pane 90 includes top frame segment 30 that includes, on its interior side, ledge 132 having shoulder 134 at its lower surface. Window pane 98 has a top frame segment 136 and has a similar ledge 138 and a shoulder 140. The third window of window set 68 includes window pane 142. Since the window set is partially raised, principally bottom frame segment 144 for the third frame is shown. Frame segment 144 includes lip 146 that extends from the exterior side of the frame segment. Lip 146 sealingly mates with shoulder 140 on the adjacent frame segment 136.

Due to the weight of the window frames and panes, some type of raising mechanism must be provided at each longitudinal end of the window frame. In this embodiment, a cable 150 is disposed within channel 84. Cable 150 is attached to the top surface of upper frame segment 136 by a clamp 152. Of course, the cable could be replaced by a chain or other mechanism that would raise the longitudinal end of window frame 136 with respect to the jamb.

Figure 4:
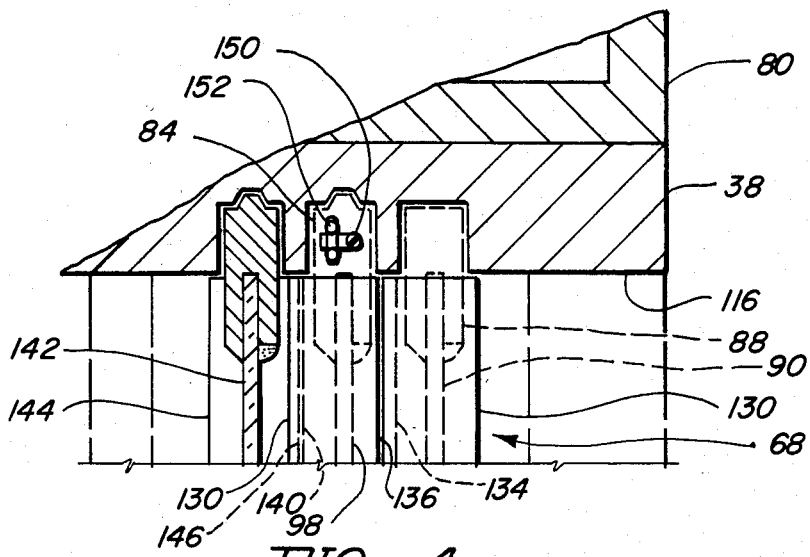
FIG. 4 illustrates a cross-sectional view of one jamb from the perspective of section line 4'—4" in FIG. 1.

FIG. 4 is a cross-sectional view from the perspective of section line 4'—4" in FIG. 1 and particularly shows jamb 38 and window set 68. Top frame segment 130 retains the upper edge of window 90; top frame segment 136 holds window 98 and bottom frame segment 144 retains the lower portions of window 142. FIG. 4 clearly shows that cable 150 is disposed within channel 84.

The portion of the superstructure surrounding jamb 38 can be made modular. A bracket can be placed on a portion of the window frames proximate the mouth of each frame channel. The brackets would attach to surface 116 of jamb 38.

FIGS. 5, 6, 7, and 8 show various portions of telescoping column 44. All the telescoping columns are substantially similar as are all of the jambs.

Figure 5:
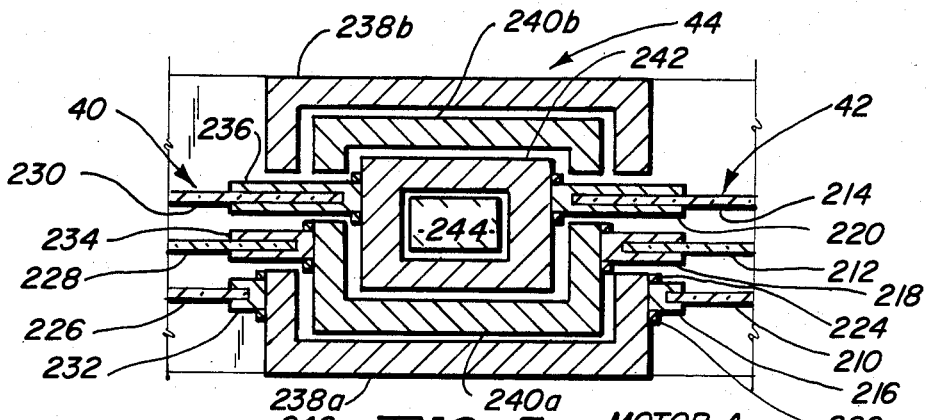
FIG. 5 illustrates a cross-sectional view of one telescoping column from the perspective of section line 5'—5" in FIG. 1.

FIG. 5 is a cross-sectional view of telescoping column 44 from the perspective of section line 5'—5" in FIG. 1. Window set 42 includes windows 210, 212 and 214. These windows are set in respective frames 216, 218 and 220. Each frame is mounted to a column segment by a pair of brackets that provide for the modularity of the window assembly. For example, frame 216 is bracketed to the corresponding column segment by brackets 222 and 224.

Window set 40 includes windows 226, 228 and 230. Window frames 232, 234 and 236 respectively retain panes 226, 228 and 230. In a similar fashion to the window set 42, the window frames of window set 40 are likewise bracketed to corresponding column segments. The inboard ends of frames 232, 234 and 236 are horizontally aligned for aesthetic purposes.

Telescoping column 44 includes three column segments and each column segment generally includes an elongated, vertically oriented interior portion and exterior portion. Column segment 238 includes interior portion **238*a* and exterior portion 238*b* disposed respectively on the interior side of the superstructure and the exterior side of the superstructure. Column segment 240 includes portions 240*a* and 240*b*. A fixed or lower column segment 242 as interior and exterior portions. Column segment 242 includes in its interior a riser 244 that is utilized to raise column segments 240 and 238**.

Internal or lower column segment 242 is fixed and therefore windows 230 and 214 as well as their corresponding frames 236 and 220 do not move. However, the remaining windows in each window set do move with respect to the fixed lower windows and lower column 242. This movement is due to the vertical positioning of riser 244. Exterior column segments **240*b* and 238*b* enhance the stability of the telescoping column. Column segments 238*a* and 240*a* are attached to window frames 234, 232, 218, and 216**.

Figure 6:
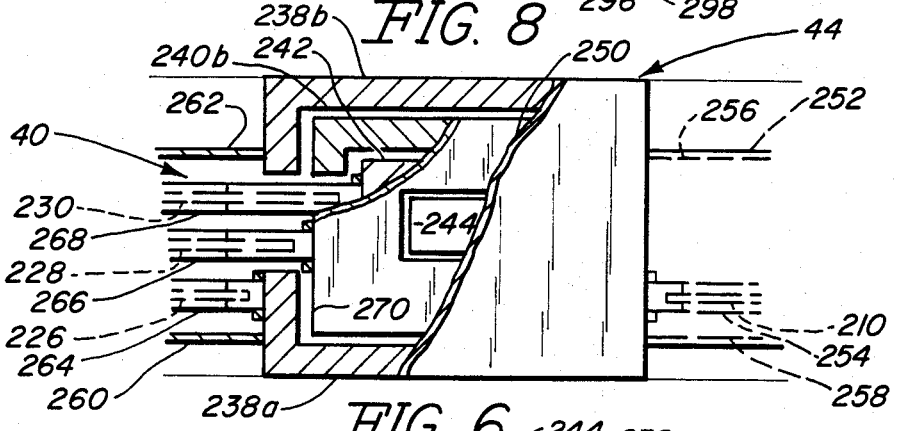
FIG. 6 illustrates a partial, broken away top view of a telescoping column from the perspective of section line 6'—6" in FIG. 1.

FIG. 6 illustrates a partial, broken away view of telescoping column 44 from the perspective of section line 6'—6" in FIG. 1. In general, the column segments are attached to each other by a cap. Column segments **238*a* and 238*b* are attached by cap 150. Cap 250 in turn is attached to a railing 252 that extends from telescoping column 44 to the longitudinal end of the window set proximate jamb 35. The underside of railing 252 is attached to the top frame segments 254 of window 210. Also the lateral extent of the railing is such that it covers all the windows of the window set. Railing 252 has downwardly extending lips 256 and 258 along the exterior and interior surface planes of superstructure 16. The lateral expanse of the railing is best shown with respect to the window set 40 wherein downwardly extending lips 260 and 262** are shown in cross-section.

The top portions of pane 226 of window set 40 is retained by upper frame segment 264. That frame segment is attached to the underside of the railing that is not shown in FIG. 6. Windows 228 and 230 are held by top frame segments 266 and 268, respectively. Top frame segment 266 extends through a mouth defined between column segments **238*a* and 238*b* and is attached to cap 270. Cap 270 is attached to column segments 240*a* and 240*b*. Pane 230 and associated frame 268 extends through a mouth defined by column segments 238*a* and 238*b*, extends through a mouth defined by column segments 240*a* and 240*b* and is attached to internal or lower column segment 242**.

Riser 244 acts upon the underside surface of cap 250 thereby initially raising windows 226 and 210. When the bottom-most end of those windows is raised above top frame section 266 of window pane 228 and above the top frame segment of window 212 (See FIG. 5), the two intermediate windows 228 and 212 respectively of window sets 40 and 42 are raised due in part to the mating between a shoulder on the top frame segment of the intermediate window frame and a flange on a bottom frame segment of the interior window frame as best shown in FIG. 3 with respect to windows 98 and 142.

Figure 7:
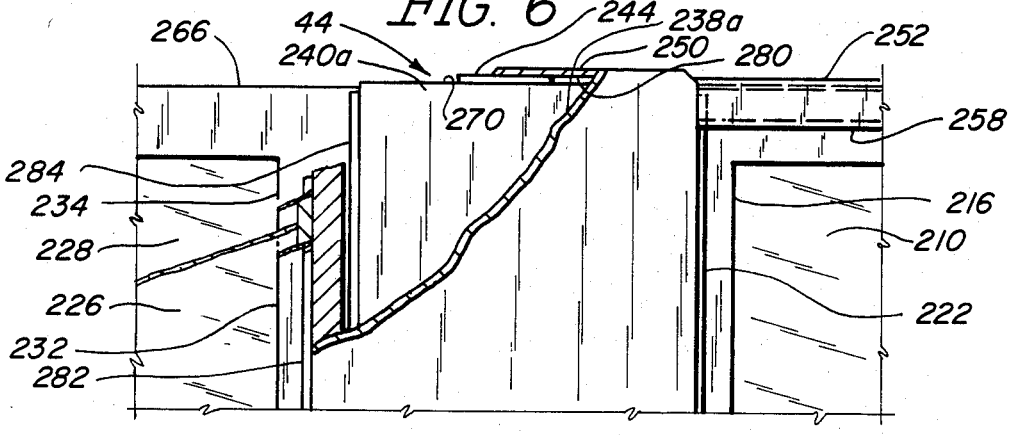
FIG. 7 illustrates a partial, broken away side view of the telescoping column from the perspective of section line 7'—7" in FIG. 1.

FIG. 7 is a partial, broken away, side view of telescoping column 44 from the perspective of section line 7'—7" in FIG. 1. FIG. 7 shows riser 244 acting on the underside surface 280 of cap 250. Frames 232 and 216 and the corresponding windows 226 and 210 are attached to column segment **238*a* via brackets 222 and 282 generally extending the vertical expanse of each window. In a similar fashion, window 228 is retained within frame 234 which in turn is attached to column segment 240*a* by way of bracket 284. Top frame segment 266 of window 228 is attached to cap 270** of the intermediate column section.

Figure 8:
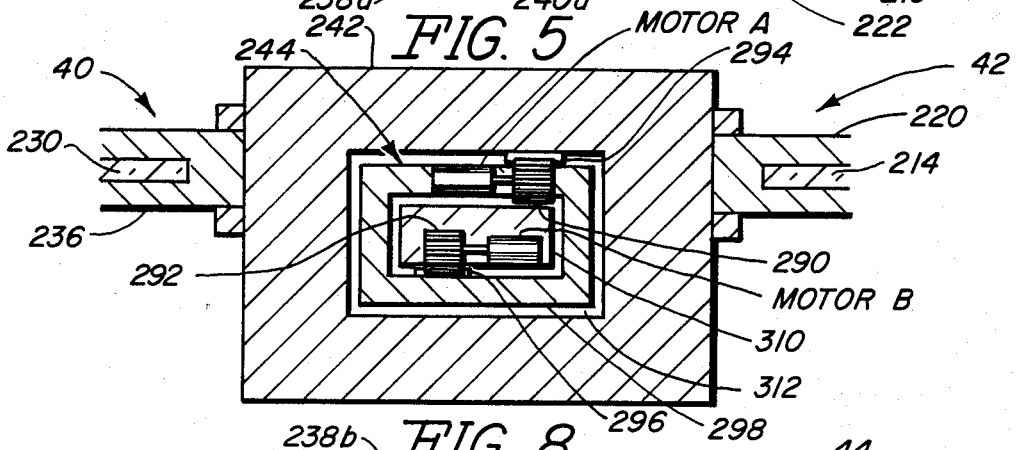
FIG. 8 illustrates a generally cross-sectional plan view of the internal or lower column showing the raising and lowering mechanism for the column in accordance with the principles of the present invention; and, FIG. 9 illustrates a plan view of the raising and lowering mechanism for the windows in jamb in accordance with the principles of the present invention.

FIG. 8 is a plan, cross-sectional view principally of inner or fixed column segment 242 and riser 244. Riser 244 in this embodiment includes motors A and B which rotate circular gears 290 and 292 respectively. The teeth of gears 290 and 292 are meshed with vertically extending tracks 294 and 296 respectively. Motor A is set in riser structure 298 and motor B is set riser structure 310. Generally, a cap is placed over riser structure 310 and it is the outside surface of the cap that acts upon underside surface 280 of cap 250 for column segment 238.

In operation, motor A is initially activated thereby raising riser structure 298 due to the climbing action along the gear rail or track. When motor A reaches the upper limit of gear rail 294, motor B is activated thereby raising riser structure 310 to the upper limit of gear rail 296. Of course, a plurality of rails may be added to riser structure 298 to provide stability within interior surface 312 of internal column 242. Also, hydraulics could be utilized to raise riser 244 rather than electromotive power. A manual raising mechanism can be incoporated rather than electromotive. The claims appended hereto are means to cover these changes.

Figure 9:
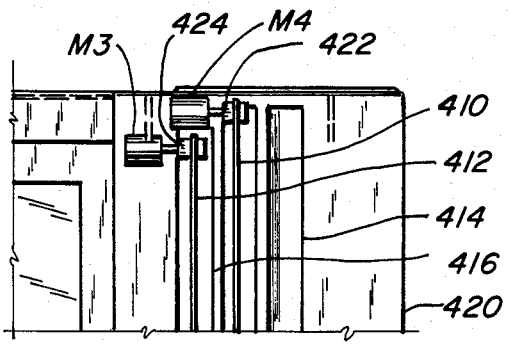

FIG. 9 illustrates a plan view of the raising mechanism for the cables attached to the longitudinal ends of the movable window frames adjacent the jambs. Cables 410 and 412 are disposed in frame channels 414 and 416 respectively. These frame channels are part of jamb 420.

Motors $M_3$ and $M_4$ utilized spools 424 and 422 to wind and unwind cables 412 and 410, respectively. Again, other mechanisms could be used to railing the longitudinal ends of the window frames other than motors $M_3$ and $M_4$. For example, motors $M_3$ and $M_4$ could be replaced by a single motor with a clutch and a gear train.

In all situations, motors A, B, $M_3$, and $M_4$ must be synchronized with respect to raising the window frames. As can be seen from FIG. 1, the window frames are supported at their longitudinal ends by a telescoping column and either an adjacent telescoping column or a cable disposed in a frame channel of a jamb. Therefore, the telescoping columns and the raising mechanisms acting on the frames that are movable in the channels must be synchronized in order to raise and lower an entire wall of windows.

The claims appended hereto are meant to cover modifications and changed of the invention within the scope and spirit of the invention. For example, the raising mechanism for the windows may be altered from, for example, the use of electromotive force to the use of hydraulics. Although the illustrated embodiment discuss window sets having three windows, window sets having many more windows could be constructed in accordance with the principles of this present invention. Also, the fixed window can be the interior or inside window rather than the exterior window shown herein. Further, although three superstructures are shown in this embodiment, a plurality of superstructures could be jointed together by vertical corner posts rising from the surface of the balcony or patio area. These modifications and changes are meant to be encompassed by the appended claims.

What I claim is:

1. A guardrail window assembly for a patio or balcony area comprising:

a plurality of outer, stationary, rectangular superstructures connected together by vertical posts rising from said area and interposed between adjacent superstructures, each superstructure including:

a header defining an upper horizontal extent of said superstructure;

a footer defining a lower horizontal extent of said superstructure and being adapted to be set on said area, said footer having a plurality of upwardly open longitudinal window frame grooves;

a pair of upright jambs extending between said footer and header at the longitudinal ends thereof, one jamb thereof adapted to be attached to one of said posts, each jamb including a plurality of window frame channels open inboard of said superstructure;

the window assembly further including:

a plurality of window frames each retaining a respective pane;

a plurality of telescoping columnar supports, at least one telescoping column thereof uprightly disposed between said pair of jambs in said superstructure and disposed on said footer, each telescoping column including:

a plurality of elongated column segments that telescope from a foreshortened column to a fully extended column that vertically extends from the top of said footer to the bottom of said header, a lower column segment of said plurality of column segments being fixed to said footer and the remaining column segments movably attached to telescope from said lower column segment;

means for raising and lowering said remaining column segments disposed within said telescoping column; and, the window assembly wherein:

each window frame is mounted between a respective column segment and a respective jamb or mounted between two respective column segments of adjacent telescoping columns such that when said telescoping columns form foreshortened columns, a subplurality of window frames are substantially horizontally aligned and vertically movable with respect to each other, one window frame of said subplurality being affixed to said lower column segment and affixed to said footer in one of said window frame grooves and affixed to a portion of one of said plurality of frame channels when said subplurality is disposed between a corresponding telescoping column and a corresponding jamb, another window frame of said subplurality that is disposed between adjacent telescoping columns being affixed to respective lower column segments thereof and affixed to said footer in one of said window frame grooves, the remaining window frames of said subplurality affixed on one vertical side to a respective telescopically movable column segment, the opposing side of said remaining frames that are disposed between adjacent telescoping columns being affixed to a respective column segment, and the opposing side of said remaining frames that are disposed between said corresponding telescoping column and said corresponding jamb being movably disposed within a respective one of said frame channels;

means for moving synchronized with said means for raising and acting upon the sides of the remaining window frames disposed in said frame channels, said second means for moving being at least partially disposed within the corresponding frame channel for each said remaining window frame.

2. A window assembly as claimed in claim 1 wherein three window frames form said subplurality of window frames, the vertical span of said three frames substantially equal to the vertical span between said footer and said header.

3. A window assembly as claimed in claim 2 wherein said subplurality of windows form a set of window frames and corresponding panes thereof are disposed inboard of a respective superstructure, said set forming a wall when all telescoping columns inboard of said respective superstructure form fully extended columns.

4. A window assembly as claimed in claim 3 wherein said header of said respective superstructure includes a longitudinal, downwardly open groove and the uppermost edge of the highest window frames in each said set inboard of said respective superstructure mate within said downwardly open groove when said wall is formed.

5. A window assembly as claimed in claim 4 wherein said panes are made of a transparent material.

6. A window assembly as claimed in claim 5 wherein a railing means is disposed along said uppermost edge, said railing means fitting within and mating with said downwardly open groove when said wall is formed.

7. A window assembly as claimed in claim 6 wherein said railing means has a lateral span such that all window frames of said set are disposed below said railing means.

8. A window assembly as claimed in claim 4 wherein the remaining windows of said set are vertically moved in a synchronized manner by said synchronous operation of all said means for raining and said means for moving.

9. A window assembly as claimed in claim 1 wherein said means for moving includes motor means in said header and a cable means wound on a spindle acted upon by said motor means, said cable means disposed in said frame channels for each movable window frame.

10. A window assembly as claimed in claim 1 wherein said footer includes lateral grooves as its bottom-most surface which form water escape passages when said footer is attached to the surface of said area.

11. A window assembly as claimed in claim 1 wherein said panes are transparent window panes.

* * * * *